US005974592A

United States Patent [19]

Tabrizi

[11] Patent Number: 5,974,592

[45] Date of Patent: Nov. 2, 1999

[54] UNDERGARMENT

[76] Inventor: Ahmad Ebadi Tabrizi, 101-234-5th Avenue East, Vancouver, Canada, V5T 1H2

[21] Appl. No.: 09/104,419

[22] Filed: Jun. 25, 1998

[51] Int. Cl.[6] ..... A41B 9/00

[52] U.S. Cl. ..... 2/400; 2/406; 450/99

[58] Field of Search ..... 2/400–403, 405, 2/406, 408, 228, 238, 227, 114; 450/97–99, 131–132; 66/177, 172 E, 191

[56] References Cited

U.S. PATENT DOCUMENTS

| | | | |
|---|---|---|---|
| 2,250,218 | 7/1941 | Cadous | 2/106 |
| 2,462,195 | 2/1949 | Jacobson | 2/106 |
| 2,980,114 | 4/1961 | Montoya | 450/99 |
| 3,080,869 | 3/1963 | Alberts | 450/99 |
| 3,131,698 | 5/1964 | Morano | 450/99 |
| 3,499,442 | 3/1970 | Steinmetz | 2/403 |
| 3,710,397 | 1/1973 | Tsujimoto | 2/403 |
| 5,611,722 | 3/1997 | Osborne . | |
| 5,708,986 | 1/1998 | Belardinelli | 2/406 |
| 5,784,723 | 7/1998 | Noble et al. | 2/400 |
| 5,787,732 | 8/1998 | Perron et al. | 2/401 X |

FOREIGN PATENT DOCUMENTS

| | | |
|---|---|---|
| 9059805 | 3/1997 | Japan . |

*Primary Examiner*—Gloria Hale
*Attorney, Agent, or Firm*—John Russell Uren

[57] ABSTRACT

An undergarment (200) designed principally for a male user (214) to provide lifting support and shape enhancement for the buttock and crotch areas (210, 213). A first fabric (202) covers the buttock (210) and crotch areas (213) of a user (214). A second fabric (203) extends downwardly from the back and central area of the waistband (201) of the undergarment (200) to support and encircle the buttocks (210) and thence returns to the waistband (201) at the sides of the undergarment (200). A third fabric material (212) extends downwardly from both sides of the waistband (201) and encircles the crotch (213) to provide support and enhancement of the crotch area (213). The second and third fabrics (203, 212) are elasticized. The first material (202) is a cotton/spandex stretch fabric.

6 Claims, 2 Drawing Sheets

UNDERGARMENT

INTRODUCTION

This invention relates to an undergarment and, more particularly, to an undergarment that lifts and supports and thereby provides shape enhancement of the body of a male user in the crotch and buttock areas.

BACKGROUND OF THE INVENTION

Undergarments for protecting the sensitive body areas are, of course, well known. Likewise, undergarments to provide for more pleasing body profiles are also known such as girdles and brassieres for women. However, such undergarments for men are unusual and, generally, do not provide an enhancement for the body profile in the crotch or buttock areas.

SUMMARY OF THE INVENTION

According to one aspect of the invention, there is provided an undergarment for the lifting support and shape enhancement of the buttock area of a user comprising a waist band for encircling the waist of a user, a first fabric material extending from said waistband and encircling a substantial portion of said buttock area, a second fabric material extending downwardly from said waistband in the central area between said buttocks and outwardly from said lowermost area of said buttocks on both sides of said central area, said second fabric material returning to said waistband on both sides of said user after encircling said buttocks, said second fabric being made from an elasticized material.

According to a further aspect of the invention, there is provided an undergarment for the lifting support and shape enhancement of the crotch area of a user comprising a waistband for encircling the waist of a user, a first fabric material extending from said waistband and encircling and covering a substantial portion of the abdomen area of said user, a third fabric material extending downwardly from said waistband at the sides of said user, said third fabric surrounding and lifting the crotch of said user.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1A:
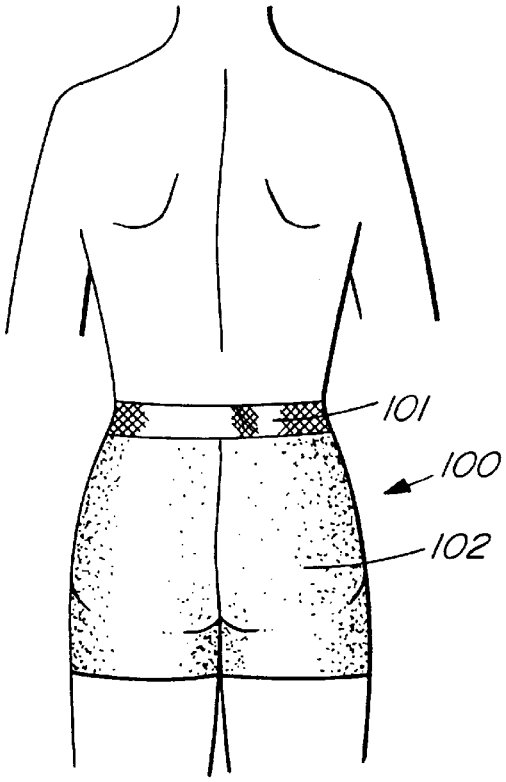
FIG. 1A PRIOR ART
FIGS. 1A, 1B and 1C are diagrammatic rear, side and front views, respectively, of a prior art typical undergarment in use at the present time.
Figure 1B:
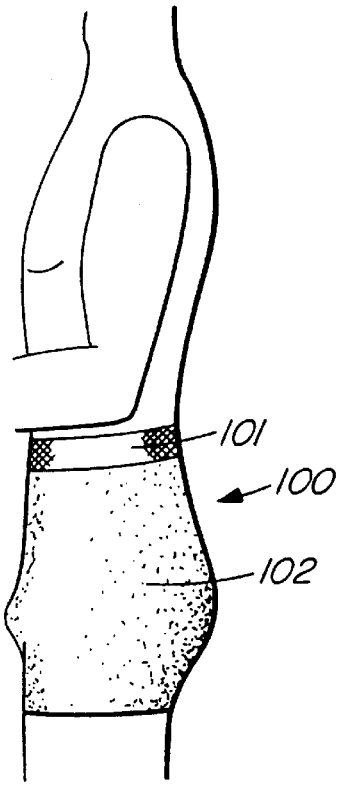
FIG. 1B PRIOR ART
Figure 1C:
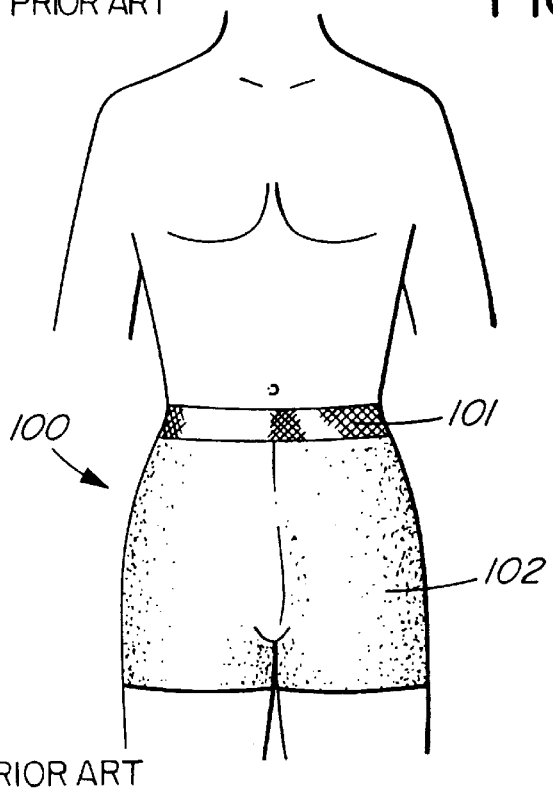
FIG. 1C PRIOR ART

Referring now to the drawings, an undergarment according to the prior art is generally illustrated at 100 in FIGS. 1A, 1B and 1C. It is in the form of a boxer short and has a waistband 101 and a general body covering area 102. The waistband 101 is made from an elasticized material and the body area 102 is generally made from a soft material such as cotton or the like to prevent chaffing and provide comfort for the sensitive body parts. The absence of any particular supporting material within the body portion 102 will be noted.

Figure 2:
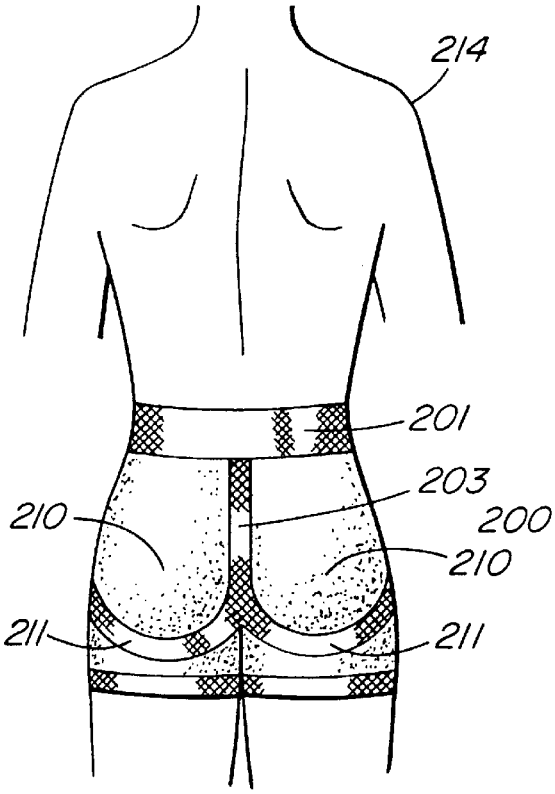
FIG. 2 is a diagrammatic rear view of the undergarment according to the present invention.
Figure 3:
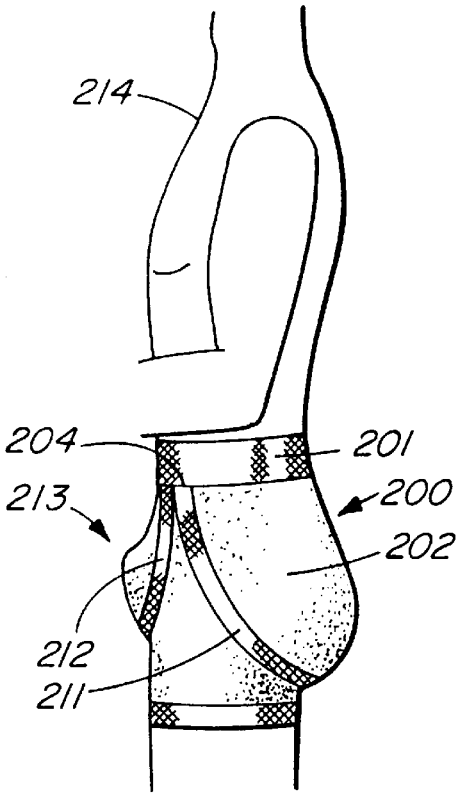
FIG. 3 is a diagrammatic side view of the undergarment of FIG. 2.
Figure 4:
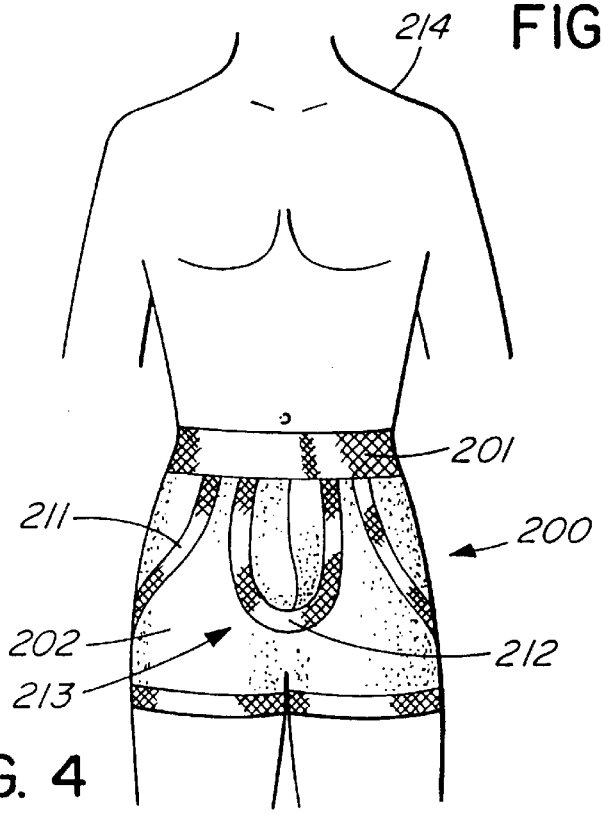
FIG. 4 is a diagrammatic front view of the undergarment of FIG. 2.

The undergarment according to the present invention is generally illustrated at 200 in FIGS. 2, 3 and 4. The undergarment 200 likewise has an elasticized waistband 201, conveniently approximately four (4) inches wide, which is connected to a body cover portion 202 generally covering the entire buttock and crotch areas of a male user. The body cover portion 202 is conveniently made from a four-way stretch material such as a cotton/lycra stretch fabric.

With reference to FIG. 2, the elasticized waistband 201 extends downwardly in a first portion 203 located between the buttocks 210 and curves under the buttocks 210 in two second portions 211 which provide lift and support for and enhances the shape of the buttocks 210 as is particularly illustrated in FIG. 3. The second portion 211 extends forwardly as it joins again with the waistband 201 in a forward area 204 by the sides of the user 214.

With reference to FIG. 4, a third elasticized portion 212 extends downwardly from the elasticised waistband 201 and around the crotch area generally illustrated at 213. The third portion 212 provides support for and enhances the shape of the crotch area 213 in a manner similar to the manner the buttocks 210 are supported and lifted and thereby enhanced by the elasticized first and second portions 203, 211, respectively. All three (3) portions 203, 211 and 212 are conveniently made from an elasticized material.

OPERATION

The operation of the undergarment 200 is apparent. The user 214 will simply pull the undergarment 200 over his buttocks and crotch areas 210, 213, respectively. The elasticized portion 211 beneath the buttocks 210 will provide support for and lift the buttocks 210 causing an enhancement of the shape of the buttocks 210 which will then protrude rearwardly in a more prominent shape as is illustrated in FIG. 3. Simultaneously, the elasticized portions 212 will provide support for and enhance the shape of the crotch area 213 as is illustrated in FIG. 4.

While the undergarment 200 is intended to be available in the usual clothing sizes according to the circumference of the waist of user 214, the elasticity of the first, second and third portions 203, 211, 212 may be varied by the use of a different material or material having a different elasticity. Likewise, the user may not need or desire support or enhancement of an individual one of either the buttocks and crotch areas 210, 213, respectively. In this case, he may simply use either the support and enhancement for the buttocks 210 or, alternatively, the support and enhancement of the crotch area 213.

Many further modifications will readily occur to those skilled in the art to which the invention relations and the specific configurations described should be taken as illustrative of the invention only and not as limiting its scope as defined in accordance with the accompanying claims.

What is claimed is:

1. An undergarment for lifting support and shape enhancement of the buttock area of a user comprising a waistband for encircling the waist of a user, a first fabric material extending from said waistband and encircling a substantial portion of said buttock area, said buttock area having a central portion and a lowermost area below said buttock area, a second fabric material extending downwardly from said waistband in said central portion between said buttocks and outwardly from said lowermost area of said buttocks of both sides of said central area, said second fabric material returning to said waistband on both sides of said user after encircling said buttocks, said second fabric material being made from a elasticized material.

2. An undergarment as in claim 1 wherein said undergarment has front and side areas and further comprising a third fabric material extending downwardly from said waistband in said front and side areas of said undergarment, said user having a crotch area, said crotch area having a bottom, said third fabric material encircling said bottom of said crotch area of said user and returning to said waistband in said front and side areas of said undergarment.

3. An undergarment as in claim 2 wherein said first fabric material is a cotton/spandex material.

4. An undergarment as in claim 3 wherein said second and third materials are made from an elasticized material.

5. An undergarment for lifting support and shape enhancement of the crotch area of a user comprising a waistband for encircling the waist of a user, a first fabric material extending from said waistband and encircling and covering a substantial portion of the abdomen area of said user, a third fabric material extending downwardly from said waistband at the sides of said user, said third fabric material surrounding and lifting the crotch of said user, said undergarment having a back area, a central area and a lowermost portion, said first fabric material extending downwardly from said waistband at the back and central area of said undergarment to cover a substantial portion of the buttocks of said user, and further comprising a second fabric material extending downwardly from said waistband in the central area between said buttocks and outwardly from said lowermost portion below said buttocks on both sides of said central area to contact said lowermost portion of said buttocks, said second fabric material returning to said waistband on both sides of said user, said second fabric material being made from an elasticized material.

6. An undergarment for lifting support and shape enhancement of the crotch area of a user comprising a waistband for encircling the waist of said user, a first fabric material extending from said waistband and encircling and covering a substantial portion of the abdomen area of said user, a second fabric material extending downwardly from said waistband at the sides of said user, and third fabric material being separate and not connected with said second fabric material, said third fabric material extending downwardly from said waistband and surrounding and lifting the crotch of said user.

* * * * *